United States Patent [19]

Jimenez

[11] Patent Number: 4,848,130

[45] Date of Patent: Jul. 18, 1989

[54] APPARATUS FOR USE WITH VEHICLE FRAME STRAIGHTENER

[76] Inventor: Jose R. Jimenez, 317 E. 178 St., Apt. 5H, Bronx, N.Y. 10457

[21] Appl. No.: 212,203

[22] Filed: Jun. 27, 1988

[51] Int. Cl.[4] ..... B21D 1/12

[52] U.S. Cl. ..... 72/392; 72/457; 72/705

[58] Field of Search ..... 72/447, 392, 457

[56] References Cited

U.S. PATENT DOCUMENTS

| | | | |
|---|---|---|---|
| 4,201,076 | 5/1980 | Jarman et al. | 72/705 |
| 4,296,626 | 10/1981 | Jarman et al. | 72/705 |
| 4,309,894 | 1/1982 | Connor | 72/705 |
| 4,586,359 | 5/1986 | Parks | 72/705 |

OTHER PUBLICATIONS

E.P.A. 0,067,049, pub. Dec. 15, 1982, Inventor: Charles A. Mosiman.

E.P.A. 0,253,269, pub. Jan. 20, 1988, Inventor: Paolo Cortinouis.

"Padgett Puller" by O'Neal Steel Products Co., pp. 1–4, (received in P.T.O. on Dec. 5, 1961).

*Primary Examiner*—Robert L. Spruill

*Attorney, Agent, or Firm*—Sanford J. Piltch

[57] ABSTRACT

Apparatus for use in the repair and realignment of body/frame portions of a vehicle having unitized body and frame construction comprising a base member for attachment to a body/frame reference point and a connector rotatably adjustable within said base member for attachment to body/frame straigtening and alignment equipment. The apparatus provides a secure attachment to the vehicle and several orthogonally related connection points for applying forces, or combinations of forces for straightening and realigning body and frame portions of a vehicle which have been damaged by collision or otherwise.

11 Claims, 3 Drawing Sheets

FIG. 2
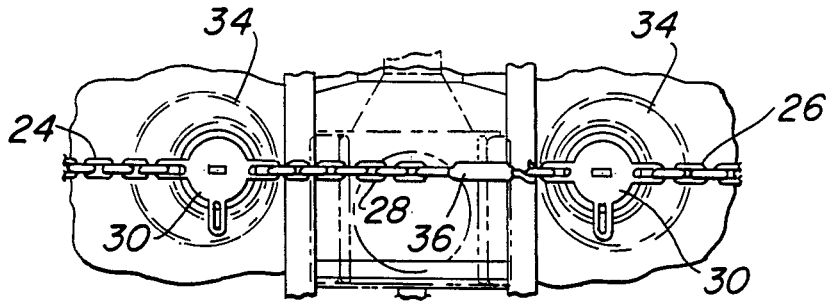
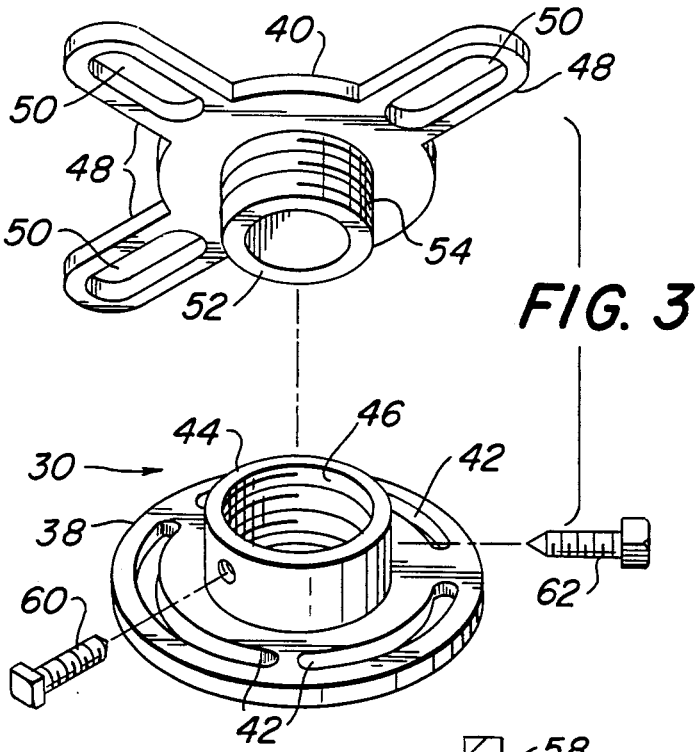
FIG. 3
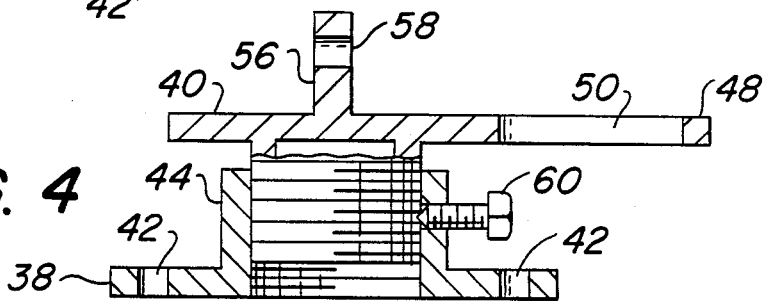
FIG. 4

APPARATUS FOR USE WITH VEHICLE FRAME STRAIGHTENER

BACKGROUND OF THE INVENTION

The invention relates to an improvement in apparatus used in repairing and straightening automobile and truck bodies and frames, particularly those of unitized sheet metal construction in which the former assembly of individual moldings and parts mounted on a skeletal base frame is replaced by unitized sheet metal subassemblies joined together by welding and/or bolting so as to structurally support one another.

The unitized body/frame design for vehicles is a comparatively recent development. Static and dynamic load transfer between the unitized sheet metal body assemblage and undercarriage wheel mounts occurs through load transfer members. The load transfer members become primary anchor points and positional references in repairing body and frame damage after collision. These load transfer members comprise the suspension members of the vehicle, i.e. shock absorbers, springs, struts and/or a combination of these types of suspension members. The suspension members are mounted within the vehicle fender well between the front axle suspension mounts and an encased protrusion of the fender into the engine compartment. The fender protrusion exhibits a substantially flat, almost horizontal upper surface through which the upper mountings for the suspension extend and are secured by bolts. These bolts provide a means for attaching an adaptor or anchor element for cooperation with a vehicle body and frame straightening and repair apparatus.

In vehicle body and frame repair shops, various floor frame structures have been used to mount and hold vehicle bodies in fixed reference positions. An assortment of jacks, chain-pulls and winches, along with various clamps and locks, have been necessary in applying the forces and combinations of forces required to restore basic positioning and alignment of body parts. Most of the commonly used equipment requires substantial time and labor in making and using a number of setups in procedural sequences in order to apply the necessary forces and combinations of forces, at the appropriate angular relationship, to each positional reference on the body, as necessary. Not infrequently, repeated alternating setups were necessary to achieve the desired positional relationships between or among several body parts. These repeated alternating procedures were expensive in terms of equipment requirements and in terms of labor cost.

Moreover, in repairing unitized automobile bodies made principally of thin sheet metal, such former equipment and procedures presented further difficulties. With such vehicles, retention of body/frame strength in the repaired state, particularly when body repairs required repeated restorative bendings of the sheet metal through extended angular ranges (to remove crumpled body areas) depended, critically, upon avoidance of metal fatigue. Additionally, misalignment of reference points of the body/frame can result in future mechanical failure which can be manifested as uneven tire wear, steering deficiencies, structural body part misalignment, etc.

It is, therefore, an object of the present invention to provide an adaptor or anchor which facilitates precise positioning of basic body/frame reference points and sections in a single setup for complete two and three dimensional alignment and positioning as appropriate directional forces and combinations of directional forces are applied.

It is a further object of the present invention to provide an adaptor or anchor for use in straightening and realigning vehicle body/frame parts which substantially obviates the need to alternate between or among several sequenced setup procedures which require connection to the same point for straightening procedures requiring different angular directions.

It is still another object of this invention to minimize the necessity of storing and of taking time to set up and return to storage a number of separate force applicators and attachments each time a new job, or step or sequence of steps of a job, is to be done, and after a job is completed.

It is still a further object of this invention to provide a repair and realignment apparatus of efficient, economical design, which can be quickly set up and used, repositioned and reused repeatedly without removal from the body/frame reference point.

It is a further object of this invention to provide a basic apparatus adaptable for use with different size and model vehicles having an extended versatility in its application to assorted types of body/frame damage.

Other objects will appear hereinafter.

SUMMARY OF THE INVENTION

The particular apparatus of the present invention is to be attached to a forward lateral portion of the uni-body frame of a vehicle at or above the front axle suspension means to create a point upon which forces, or combinations of forces may be exerted upon the body/frame by a frame straightening and aligning machine to pull the vehicle body/frame back into its original alignment.

The present invention comprises an adaptor or anchor for use with body/frame straightening and alignment equipment. The particular apparatus comprising a base member and a connector means rotatably mounted therewithin. The base member being round with slots of equal length arranged equidistant about the circumference of said base member and having a cylindrical shank extending upward from the center of said base member with screw threads along the internal surface of the shank of said base member. The connector means being a round plate having three arms extending outward from about the circumference of said connector means at intervals of 90° with each arm having an aperture to receive a connecting device to the body/frame straightening and alignment equipment and having a cylindrical shank extending downward from the center of said connector means with screw threads along the external surface of the shank of said connector means to mate with the screw threads of the shank of said base member. The connector means also having an additional connecting means extending upward from the center of said connector means having an aperture to receive a connecting device to the body/frame straightening and alignment equipment. The arms and said connecting means being disposed orthogonally of each other and when connected to the body/frame straightening and alignment equipment are used in applying forces, and combinations of forces to a body/frame reference point to straighten or align a vehicle body/frame portion. The apparatus is secured to the body/frame reference point by bolting through the slots arranged equidistant about the base member.

The slots arranged about the base member have a variety of positionings and dimensions. Arcuate shaped slots are dimensioned alike and positioned adjacent the circumference of the base member. Straight slots are also dimensioned alike and positioned extending outward at like acute angles from the circumference of the shank of the base member. "T" shaped slots are, again, dimensioned alike and positioned with the "T" facing outward between the circumference of the shank of the base member and the circumference of the base member.

A base member having slots of two different shapes has each set of different shaped slots spaced alternately and equidistantly about the circumference of the base member. The first set of slots may be "T" shaped, dimensioned alike, and positioned adjacent the circumference of the base member with the "T" facing inward, and the second set of slots may be arcuately shaped, dimensioned alike, and positioned adjacent the circumference of the shank of the base member and between adjacent "T" shaped slots. Another set of differently shaped slots may ave the first set of slots arcuately shaped, dimensioned alike, and positioned extending outward at like acute angles from the circumference of the shank of the base member, and the second set of slots straight shaped, dimensioned alike, and positioned extending outward at like acute angles from the circumference of the shank of the base member and between adjacent arcuate shaped slots.

The connector means is infinitely rotatably adjustable about its shank and within the shank of the base member by loosening and tightening set screws or bolts which protrude through the shank of the base member and contact the shank of the connector means for retaining the connector means in a chosen fixed position.

The apparatus is an anchor or connection point for the body/frame straightening and alignment equipment to the vehicle at a body/frame reference point. The body/frame reference point to which the anchor is attached is located at the point where the upper end of the attachment means of the front suspension of a vehicle protrudes through an apron protruding inward and upward from a lateral fender well of the vehicle.

BRIEF DESCRIPTION OF THE DRAWINGS

For the purpose of illustrating the invention, there is shown in the drawings forms which are presently preferred, it being understood, however, that the invention is not limited to the precise arrangement and instrumentalities shown.

FIG. 2 is a fragmentary top plan view of FIG. 1 showing the invention located atop a body fender support well.

FIG. 3 is an exploded isometric view of the invention showing each of the component parts of the invention.

FIG. 4 is a cross-sectional view of the invention taken along lines 4—4 of FIG. 1.

DETAILED DESCRIPTION OF THE INVENTION

The following detailed description is of the best presently contemplated modes of carrying out the invention. This description is not intended in a limiting sense, but is made solely for the purpose of illustrating the general principles of the invention.

Figure 1:
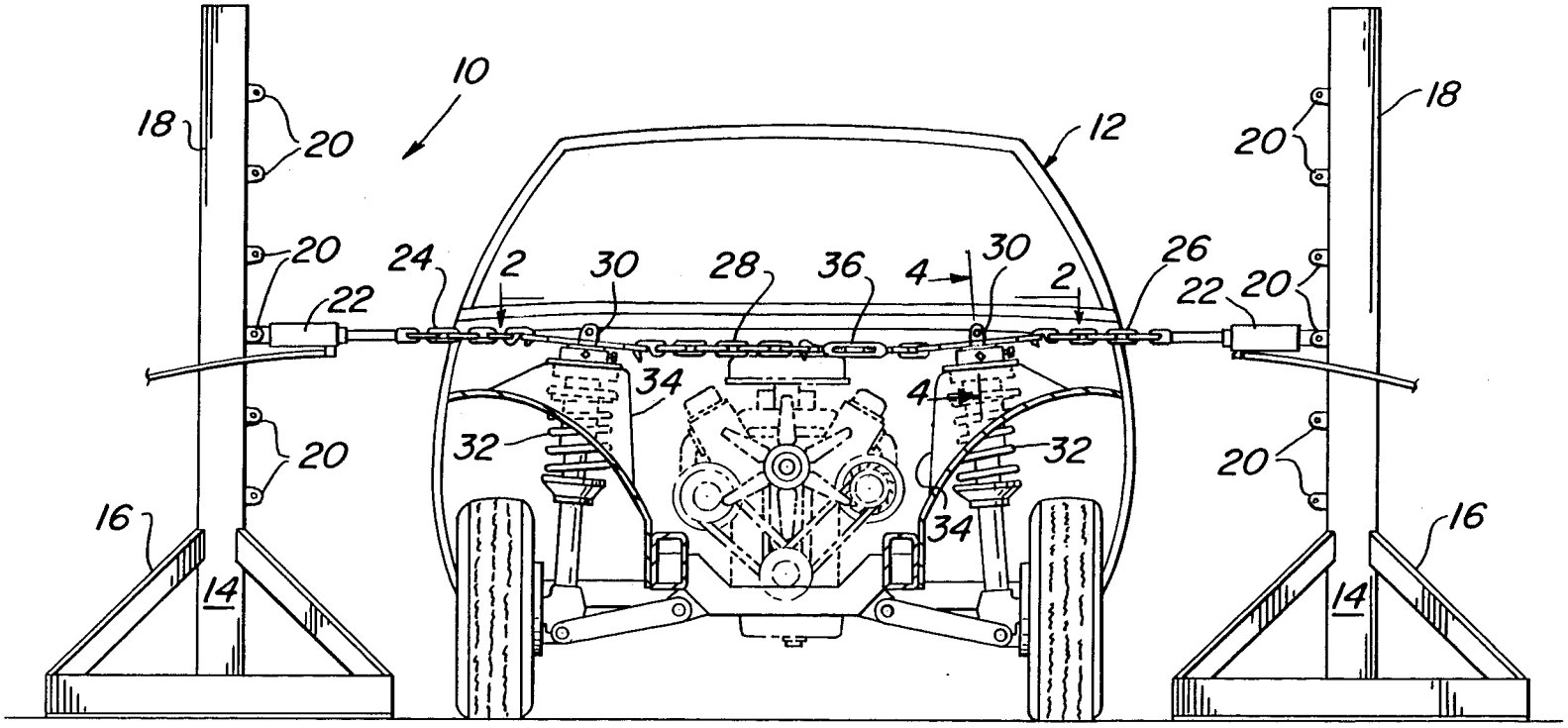
FIG. 1 is a diagrammatic overall view of the invention as used in conjunction with a vehicle body/frame straightening and realignment apparatus.

Referring now to the drawings in detail, wherein like numerals represent like elements, there is shown in FIG. 1 one type of body/frame straightening and realignment apparatus 10 as it would be used on a vehicle, in this case an automobile 12. From the diagrammatic view of FIG. 1, it can be seen that the frame straightening apparatus 10 includes two stands 14 secured to a platform (not shown) at their lower ends and stabilized by supports 16. These supports 16 keep the upright bars 18 of the stands 14 in an orthogonal relationship to the platform. Each of the upright bars 18 have a number of connection points 20 for the purpose of connecting between the upright bars 18, at the desired heights, one or more chains with chain-pulls, jacks, turnbuckles, and/or combinations of these and other devices used to straighten or realign the various body/frame parts of a vehicle.

Connected between any of the various connection points 20 are chain-pulls 22, which may be of the hydraulic or ratchet type. In the case shown in FIG. 1, the chain-pulls 22 are hydraulic operating on air pressure to pull the chain 24, 26 toward the each of the upright bars 18. One end of each chain 24, 26 is attached to one of the chain-pulls 22 and the other end is attached to the anchoring apparatus of the present invention, the anchor 30. Each of the two anchors 30 shown in the Figure are attached atop a covering or apron 34 protruding inward and upward from each of the front fender wells of the automobile 12 which house, respectively, the front suspension means 32 of the automobile. The upper end of the front suspension means 32 has several bolts which protrude through the covering or apron 34 and is secured thereto by these bolts. The upper end of the front suspension means 32 is one of several reference points used in repair of body/frame damage due to collision or otherwise.

The adaptor or anchor 30 of the present invention is attached to the front suspension reference point by removing the nuts securing the upper end bolts of the front suspension means 32 to the apron 34, placing the anchor 30 over the bolts, and reattaching the nuts to secure the anchor 30 in place. Extending between the anchors 30 atop the front suspension means 32 is another chain 28 which includes at a point approximately midway along its length a turnbuckle 36. See also FIG. 2 for placement of elements. The turnbuckle 36 is for use in keeping the front suspension reference points in alignment with each other during straightening and repair procedures. The arrangement of devices used in straightening and repair of the body/frame portions of the automobile 12 are exemplary only, as any number of different devices and/or frame straightening equipment may be used to accomplish the result. The distinction between and among the known equipment and devices and the present invention is the novel construction and use of the anchor 30.

Referring now to FIG. 3, the anchor 30 is comprised of a base member 38 and a connector means 40. The base member 38 is round with three arcuate slots 42 of equal length arranged about its mounting flange at separations of 120° around the circumference of the base member 38. Extending upward from the center of the base member 38 is a cylindrical shank 44 having threads 46 along its internal surface.

The connector means 40 is a round, flat plate having three arms 48 of equal length extending outward from about its circumference at intervals of 90°, forming a "T" shape. Each of the arms 48 has an aperture or opening 50 therein to accommodate a chain hook or other connecting device for connection with the upright bars 18 of the frame straightening and realignment apparatus 10. Extending downward from the center of the connector means 40 is a cylindrical shank 52 having threads 54 on its exterior surface which mate with the threads 46 in the base member 38. On the top of the connector means 40 extending upwards from the center of the round, flat plate is another connector means 56 in the shape of an inverted "U". The connector means 56 has a round aperture or opening 58 bored through it for connecting the top of the anchor 30 for pulling upward at angles approaching the vertical.

The base member 38 of the anchor 30 can be installed over the apron 34 and front suspension means 32 by attaching it to the bolts protruding through the apron 34, as explained previously. The base member, because of the arcuate slots may be oriented in differing angular positions to accommodate a variety of bolt spacings and arrangements. The connector means 40 is threaded down into the base member 38 so that the "T" shaped connector arms 48 face forward in the vehicle. The connector means 40 may not achieve this desired position when tightening down the threaded portions of the connector means 40 and the base member 38. Hence, the "T" shape may not face forward. In the event that this happens, the "T" shape can be located in the desired position by using the set screws 60, 62. The set screws (or bolts) 60, 62 are located approximately 120° apart about the circumference of the shank of the base member 38. These set screws 60, 62 contact the threaded, cylindrical shank 52 of the connector means 40 and, when screwed tight, the set screws 60, 62 hold the connector means 40 with it "T" shaped arms 48 in the desired position regardless of the final threaded positioning of the base member 38 and the connector means 40.

This type of connection also provides for an infinitely adjustable rotation of the connector means 40 within the base member 38. Although the desired positioning of the connector means 40 of the anchor 30 is with the "T" shape facing forward, the connector means 40 is easily rotated to accommodate a new position requirement by loosening the set screws 60, 62, rotating the connector means 40 within the threading of the mating shanks 44 and 52 to the new positioning, and tightening the set screws 60, 62. This procedure obviates the need to remove the anchor 30 and any attachment device for a chain-pull or other straightening or alignment means and replace them with a different anchor and attachment device having a different connector configuration or arrangement necessary for the next sequenced procedure. Further, the anchor 30 of the present invention provides connections for simultaneously applying orthogonal forces in four separate directions, or provides connections for simultaneously applying combinations of forces in four separate directions.

Figure 5:
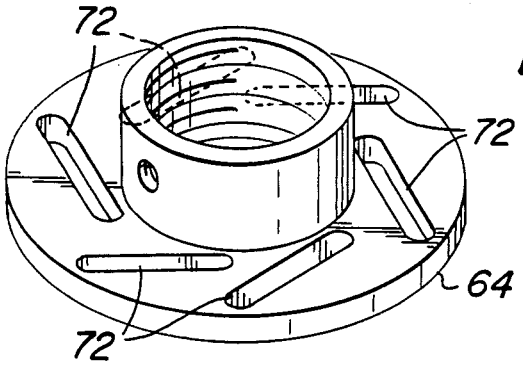
FIGS. 5–8 are modified embodiments of the mounting flange of the invention.
Figure 6:
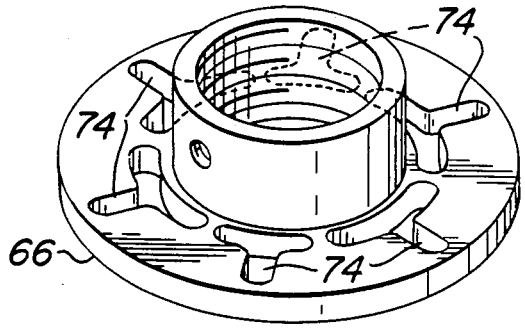

In order to accommodate the particular arrangement and number of bolts atop the apron 34 in foreign or newer model vehicles, either automobiles or trucks, the variety of base members 64, 66, 68, and 70 in FIGS. 5 through 8, respectively, may be used. With reference to FIG. 5, base member 64 has a number of straight slots 72 of equal length and dimension arrayed about the base member 64. Each of the slots 72 is positioned at a point on the circumference of the shank portion of the base member 64, with each such point being 60° separated from the next point. The slots 72 extend outward at like acute angles from points about the circumference of the shank to the circumference of the base member 64. With reference to FIG. 6, base member 66 has a number of "T" slots 74 of equal length and dimension arrayed about the base member 66. Each of the slots 74 is positioned about the circumference of the shank portion of the base member 66, with each slot 74 being centered 60° apart from the next slot center. The "T" is oriented to face outward about the circumference of the base member 66.

Figure 7:
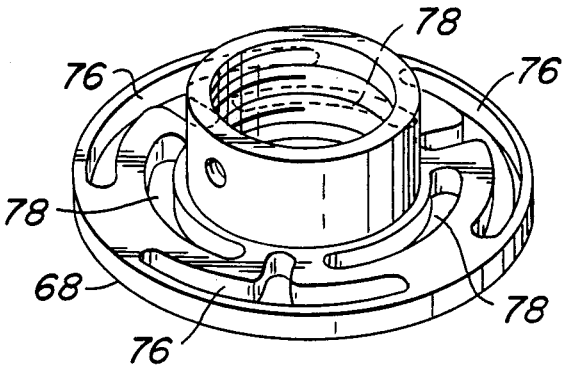
Figure 8:
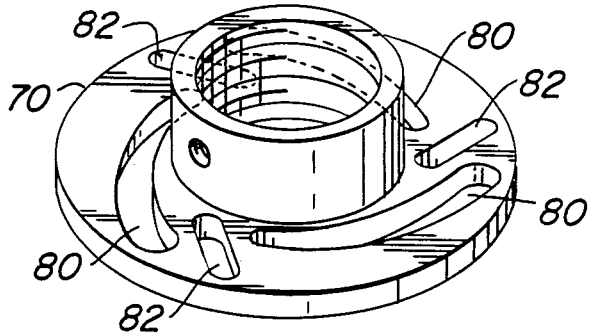

With reference to FIG. 7, the base member 68 has two sets of alternating differently shaped slots 76, 78. Slots 76 are "T" shaped and face inward with the horizontal bar of the "T" along the circumference of the base member 68. Each of the slots 76 are spaced equally around the base member 68 at 120° intervals. The vertical portion of the "T" extends between adjacent arcuate slots 78, as follows. Alternating between the slots 76 are arcuate slots 78 which are spaced equally around the circumference of the shank at 120° intervals. The arcuate slots 78 are spaced equally between adjacent vertical portions of the "T" slots 76. With reference to FIG. 8, base member 70 also has two sets of alternating differently shaped slots 80, 82. Slots 80 are arcuate and vary in aperture size from one end to the other. Each of the slots 80 are spaced equally around the base member 70 at 120° intervals. The arcuate slots 80 extend outward at like acute angles from points about the circumference of the shank, widening in aperture dimension as the slot approaches the circumference of the base member 70. Alternating between adjacent arcuate slots 80 are straight slots 82 spaced about the circumference of the shank 120° from each other. The straight slots 82 are angled in like direction to the arcuate slots 80, and both are positioned at acute angles to points about the shank circumference adjacent the innermost point of the slots 80, 82.

These alternate embodiments of the base member of the anchor 30 are each dimensioned the same as the base member 38 described above. Each of the slots in the various arrangements in these alternate embodiments are dimensioned exactly alike and are uniform along their length and width, except for the arcuate slots 80 of base member 70 which vary in width.

The anchor 30 is used with a body/frame straightening and alignment apparatus to reduce the number of setups, and tools needed for each setup. The anchor 30 also reduces the time needed to set up, break down, and set up a new setup during a sequence of procedures of straightening and realigning of the unitized vehicle body and frame. The anchor 30 is able to accomplish these reductions in tools, equipment and labor through its versatility and easily alterable functional relationship with the frame straightening and realignment apparatus. This novel device is capable of connecting four orthogonal forces, or combinations of forces and reposition the connection means without need to break down, remount and set up an anchor in the new position.

The present invention may be made of any material which exhibits sufficient strength to withstand the repeated application of forces to the apparatus without distortion, bending, breaking and/or stretching. Metal alloys of sufficient thickness are one such material, however, others exhibiting like characteristics, now known or later discovered, may be used.

The present invention may be embodied in other specific forms without departing from the spirit or essential attributes thereof and, accordingly, reference should be made to the appended claims, rather than to the foregoing specification, as indicating the scope of the invention.

I claim:

1. An apparatus for use with body/frame straightening and alignment equipment comprising a base member and a connector means rotatably mounted therewithin, said base member being round with slots of equal length arranged equidistant about the circumference of the base member and having a cylindrical shank extending upward from the center of said base member with screw threads along the internal surface of the shank of said base member, said connector means being a round plate having three arms extending outward from about the circumference of said connector means at intervals of 90° with each arm having an aperture to receive a connecting device to the body/frame straightening and alignment equipment and having a cylindrical shank extending downward from the center of said connector means with screw threads along the external surface of the shank of said connector means to mate with the screw threads of the shank of said base member, said connector means also having a connecting means extending upward from the center of said connector means having an aperture to receive a connecting device to the body/frame straightening and alignment equipment, said arms and said connecting means being disposed orthogonally of each other and when connected to the body/frame straightening and alignment equipment for applying forces, and combinations of forces to a body/frame reference point to straighten or align a vehicle body/frame portion.

2. Apparatus in accordance with claim 1, wherein said apparatus is secured to the body/frame reference point by bolting through the slots arranged equidistant about the base member.

3. Apparatus in accordance with claim 2, wherein said slots are arcuate, dimensioned alike, and positioned adjacent the circumference of the base member.

4. Apparatus in accordance with claim 2, wherein said slots are straight, dimensioned alike, and positioned extending outward at like acute angles from the circumference of the shank of the base member.

5. Apparatus in accordance with claim 2, wherein said slots are "T" shaped, dimensioned alike, and positioned with the "T" facing outward between the circumference of the shank of the base member and the circumference of the base member.

6. Apparatus in accordance with claim 2, wherein said slots are of two different sets of shapes, with each set of different shaped slots spaced alternately and equidistantly about the circumference of the base member.

7. Apparatus in accordance with claim 6, wherein a first set of slots is "T" shaped, dimensioned alike, and positioned adjacent the circumference of the base member with the "T" facing inward, and a second set of slots being arcuate shaped, dimensioned alike, and positioned adjacent the circumference of the shank of the base member and between adjacent "T" shaped slots.

8. Apparatus in accordance with claim 6, wherein a first set of slots is arcuate shaped, dimensioned alike, and positioned extending outward at like acute angles from the circumference of the shank of the base member, and a second set of slots being straight shaped, dimensioned alike, and positioned extending outward at like acute angles from the circumference of the shank of the base member and between adjacent arcuate shaped slots.

9. Apparatus in accordance with claim 1, wherein said connector means is infinitely rotatably adjustable about its shank by loosening and tightening set screws or bolts which protrude through the shank of the base member and contact the shank of the connector means for retaining the connector means in a chosen fixed position.

10. Apparatus in accordance with claim 1, wherein said body/frame reference point is disposed at the point where the upper end of the attachment means of the front suspension of a vehicle protrudes through an apron protruding inward and upward from a lateral fender well of the vehicle.

11. Apparatus in accordance with claim 1, wherein said apparatus is an anchor or connection point for the body/frame straightening and alignment equipment to the vehicle.

* * * * *